United States Patent [19]

Yohn

[11] Patent Number: 4,810,214

[45] Date of Patent: Mar. 7, 1989

[54] ELECTRICAL TERMINAL AND METHOD OF MAKING SAME

[75] Inventor: Brent D. Yohn, Newport, Pa.

[73] Assignee: AMP Incorporated, Harrisburg, Pa.

[21] Appl. No.: 109,383

[22] Filed: Oct. 16, 1987

Related U.S. Application Data

[62] Division of Ser. No. 944,315, Dec. 22, 1986, Pat. No. 4,701,004.

[51] Int. Cl.[4] ..... H01R 43/16

[52] U.S. Cl. ..... 439/842; 439/851; 439/852; 29/874

[58] Field of Search ..... 29/874; 439/842, 851, 439/852

[56] References Cited

U.S. PATENT DOCUMENTS

| | | | |
|---|---|---|---|
| 3,475,720 | 10/1969 | Culver | 339/217 S |
| 4,345,373 | 8/1982 | Lacaze, Jr. | 29/874 |
| 4,701,004 | 10/1987 | Yohn | 439/871 |

*Primary Examiner*—Mark Rosenbaum
*Assistant Examiner*—Taylor J. Ross
*Attorney, Agent, or Firm*—Anton P. Ness

[57] ABSTRACT

An electrical terminal machined from a cylindrical body to have a socket contact section defined by a pair of opposed beams. A method of forming the socket contact section includes forming a bore into an end of the cylindrical body and then machining opposing sides of the end of the body to form chordal surfaces therealong intersecting the bore.

7 Claims, 4 Drawing Sheets

ELECTRICAL TERMINAL AND METHOD OF MAKING SAME

CROSS-REFERENCE TO RELATED APPLICATION

This application is a divisional application of U.S. application Ser. No. 06/944,315 filed Dec. 22, 1986, now U.S. Pat. No. 4,701,004.

FIELD OF THE INVENTION

This relates to the field of electrical connectors and more particularly to contact terminals thereof.

BACKGROUND OF THE INVENTION

Contact terminals are metallic and must be secured in dielectric housings by mechanical means. Certain methods involve molding the housing around the terminals, or potting the terminals within the housing or force fitting the terminals in individual passageways for permanent retention. For retention to permit removal of a terminal conventional methods include locking fingers on a stamped and formed terminal which extend at an appropriate angle laterally to engage behind stop surfaces along the housing passageway to secure the terminal against withdrawal, but are deflectable by a tool inserted into the passageway alongside the terminal whereafter the terminal is withdrawn such as for repair or replacement. Another conventional method involves locking fingers of the plastic housing extending into the passageway which are initially deflected by the terminal during insertion and which latch behind an annular collar or stop surface of the terminal upon full insertion, and these fingers are also deflectable for terminal removal.

A variety of retention clips are known, mostly cylindrical metal sleeves which are stamped and formed to have locking fingers which engage an annular collar of a terminal and which are retained in the housing passageway in one of several ways.

One common method is to secure a retention clip in a larger diameter passageway portion, where smaller diameter passageway portions at each end define opposing stop surfaces which secure the correspondingly larger diametered clip therebetween. But forming such larger diameter passageway portions in a housing necessitates making the housing from two molded parts adjoining in a plane cutting through the larger diameter passageway portions; the clips are secured in respective halves of the passageway portions of one housing part, and the other housing part is then placed thereagainst and bonded. An example thereof is shown in U.S. Pat. No. 4,585,294. It is desirable to eliminate the necessity of a two part housing and the alignment and bonding steps, where the two parts are used just to retain the retention clips.

In some connector assemblies retention clips are secured to the respective terminals prior to assembly in the housing, such as in done in U.S. Pat. Nos. 3,009,130 and 3,187,297 which delimit axially rearward movement of the terminal in the passageway after full insertion from rearward thereof and allow rearward removal if an insertion tool (such as shown in U.S. Pat. No. 3,009,130) is inserted from the front end to deflect the clip's latching projections.

SUMMARY OF THE INVENTION

The retention clip of the present invention is especially adapted to retain a terminal in a housing passageway of a one-piece housing in a manner allowing removal of the terminal from the same face of the housing as the face into which a removal tool is inserted. The clip is stamped and formed to have circumferentially spaced pairs of outwardly struck lances with facing free ends spaced to receive an annular ridge of the housing passageway between the facing free ends of the pairs of lances and latch, to secure the clip in the passageway. At the leading end of the clip are short inwardly struck projections to stoppingly engage a terminal inserted from the other end of the clip, by engaging an annular stop surface towards the a front end of the terminal. At the trailing end of the clip are an opposing pair of long inwardly angled latching fingers which extend along the clip from the trailing end, to engage another annular stop surface towards the a rear end of the terminal, and which are accessible by a removal tool inserted from the housing face associated with the trailing end of the clip, so that the latching fingers are outwardly deflected to remove the terminal from the clip and the housing passageway via the same face. The trailing clip end is preferably as large as the passageway to engage the passageway walls and stabilize the terminal therein, and also act as a lead-in during terminal insertion. The deflectable latching fingers can be inwardly struck lances or they may be doubled back ears extending from a body section of the clip. The clip can easily be used where the terminal has a pin contact section at the end along which the removal tool is insertable.

According to another aspect of the invention, the clip may be used with a screw machined terminal having a socket contact section at the end along which the removal tool is desired to be insertable. The socket contact of such a terminal conventionally has cantilever arms formed by longitudinal slits cut into the cylindrical end, but at least at their inner end the arms join a large diameter body portion of the terminal (or adjoin a short necked down portion which joins the central section) which does not permit the clip's latching fingers to resile inwardly to latch behind an end of the large diameter central section of the terminal. In this aspect of the present invention opposed portions of the socket contact section are abraded away at least near the central section, along the slots between the cantilever arms to form substantially planar chordal surfaces. The chordal surfaces allow the clip's fingers to assuredly latch against a pair of stop surfaces now existing behind the central terminal section. Proper orientation is easily obtained by rotating the terminal during insertion until the clip fingers are along the chordal surfaces and firmly engage the stop surface of the central terminal section. The removal tool is easily received along the chordal surfaces to engage and deflect the clip fingers.

The present invention is usable with terminals having pin or socket contact sections, and especially terminals having a simple or clean profile with no annular collars (except a larger diameter central section) or recesses to be retained in one-piece housings. The present invention is particularly useful with a connector having a large plurality of interconnecting terminals which are not terminated to conductor wires but instead have contact sections at each end thereof, where a forward face of the connector is affixed by mounting and soldering of contact sections of its terminals to a printed circuit panel; while the other terminals remain soldered, one may be desoldered and removed and a new terminal inserted to replace it, all via the rearward mating face which is exposed to mate with a mating connector.

DETAILED DESCRIPTION OF THE PREFERRED EMBODIMENTS

Figures 1, 2, 3:
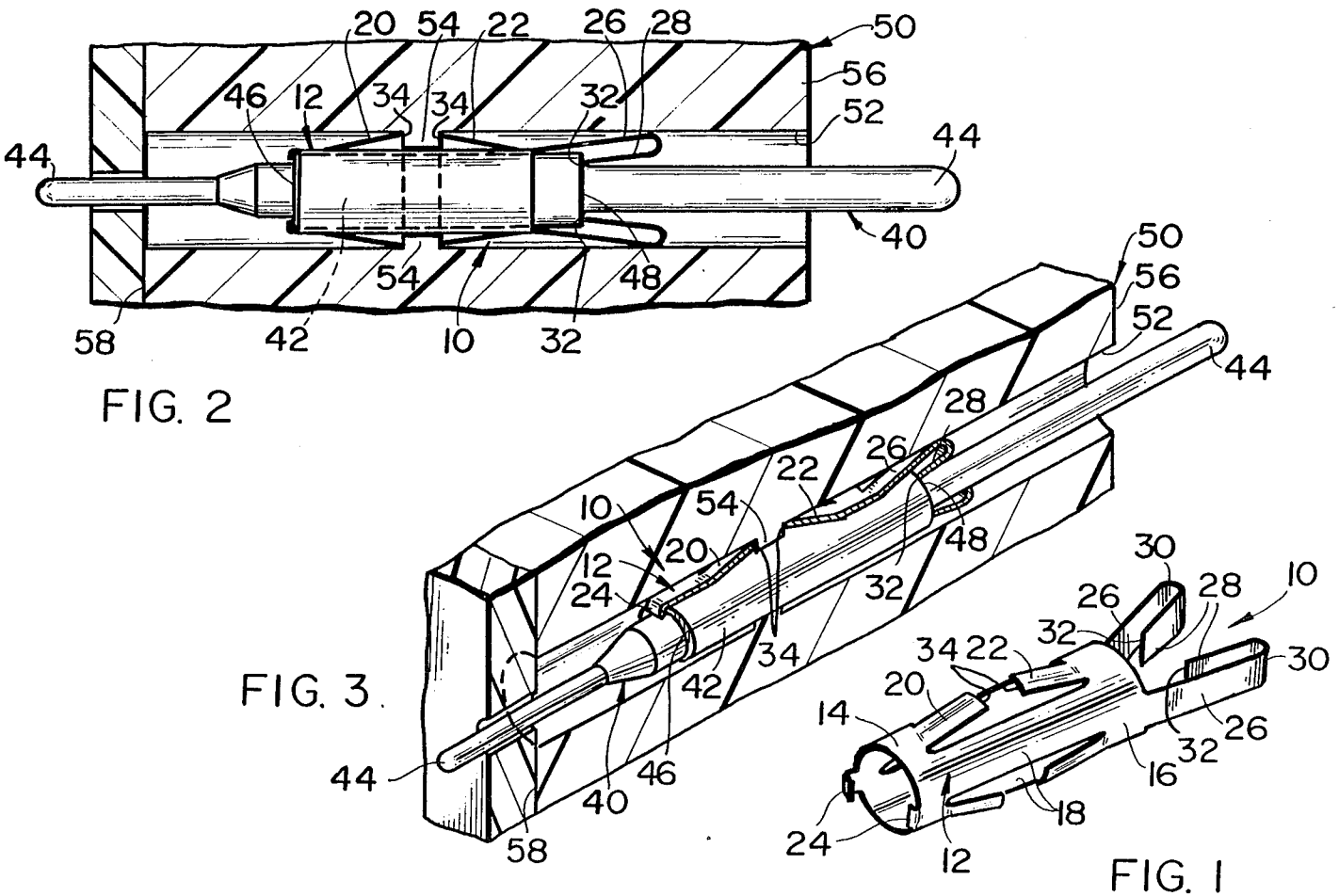
FIG. 1 is a perspective view of one embodiment of the present invention.
FIGS. 2 and 3 are longitudinal and perspective section views of the clip of FIG. 1 in a housing passageway and having a two-pin terminal secured therein.

Retention clip 10 of FIG. 1 is stamped and formed from a strip of metal such as stainless steel and having a cylindrical final form. Body section 12 comprises a cylindrical front section 14 and a cylindrical rear section 16 joined by axial bridging sections 18. Intermediate front and rear sections 14,16 are pairs of locking lances 20,22 to engage an annular stop 54 along the housing passageway 52 (FIGS. 2 and 3). At the front end of front section 14 are short stop tabs 24 bent radially inwardly. At the rearward end of rear section 16 and extending rearwardly therefrom and diverging are latching fingers comprising long ears 26 which have doubled-back converging sections 28 extending forwardly from bights 30, with free ends 32 facing rear section 16 and spaced apart a smaller distance than the diameter of body section 12.

Referring to FIGS. 1, 2 and 3 clip 10 is insertable into passageway 52 of housing 50 preferably from rearward face 56. Clip 10 is maintained within the passageway by means of preferably three circumferentially spaced sets of paired lances 20,22 latching on both sides of annular stop 54. Free ends 34 of lances 20,22 face each other and are appropriately spaced apart a distance just larger than the thickness of annular stop 54. And body section 12 has a general diameter just less than the inside diameter of annular stop 54. The forward one 20 of the lances is deflected radially inwardly during clip insertion from rearward housing face 56, by annular stop 54 but resiles outwardly after passing thereover. Terminal 40 is a screw machined part having a larger diameter central body section 42, forward and rearward pin contact sections 44 having a smaller diameter, and a forward 46 and rearward 48 stop surfaces defined between body section 42 and pin contact sections 44. When terminal 40 is inserted into passageway 52 from housing face 56 toward forward face 58, forward stop surface 46 is engaged by stop tabs 24 of clip 10. Terminal body section 42 deflects outwardly the converging sections 28 of clip ears 26 during insertion, and converging sections 28 then resile with free ends 32 latching behind rearward stop surface 48 of terminal 40, securing the terminal within passageway 52. Clip body section 12 preferably has an inner diameter larger than the outer diameter of terminal body section 42 to allow the terminal to be easily inserted thereinto.

Terminal 40 is removable from housing passageway 52 by means of a conventional removal tool (not shown) inserted from housing face 56 along the rearward contact section 44, which deflects converging sections 28 radially outwardly for terminal 40 then to be pulled out of passageway 52 from rearward housing face 56.

Figures 4, 5, 6:
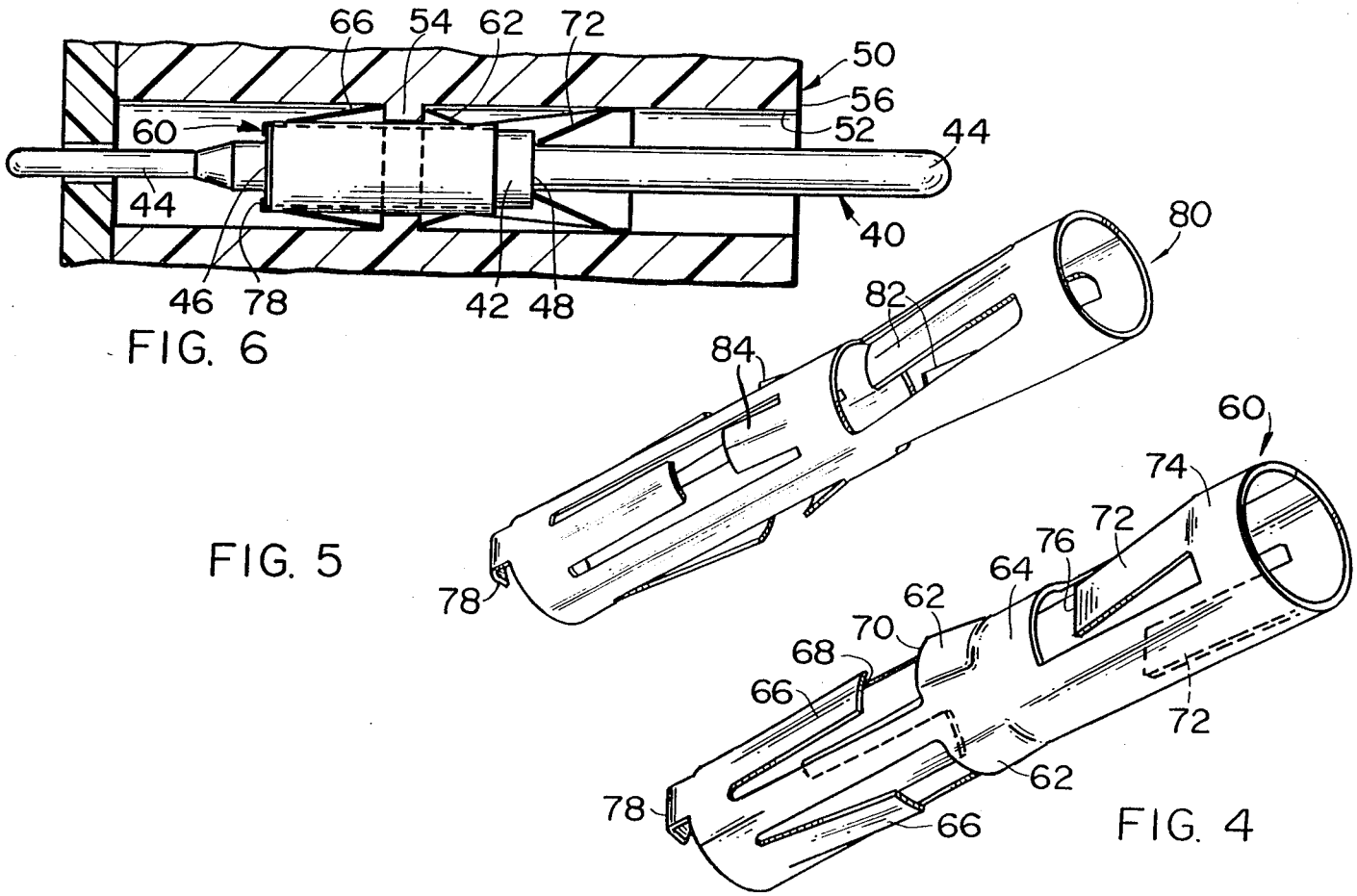
FIGS. 4 and 5 are perspective views of alternate embodiments of the present invention.
FIG. 6 is a longitudinal section view similar to FIG. 2 with the clip of FIG. 5.

FIG. 4 illustrates another retention clip 60 of the present invention wherein bosses 62 are formed in a cylindrical central clip section 64 paired with locking lances 66. Free end 68 of each lance 66 faces a raised end face 70 of a corresponding boss 62 and is spaced therefrom to receive and engage therebetween annular stop 54 of housing passageway 52. Also, clip 60 illustrates an alternate embodiment of terminal-engaging latching fingers comprising an opposing pair of projections 72 struck inwardly and extending forwardly from cylindrical rear body section 74. Free ends 76 thereon face forwardly and are spaced apart a distance less than the clip's general diameter. Terminal 40 inserted thereinto from housing face 56 deflects outwardly projections 72 which then latch behind rearward terminal stop surface 48 while forward terminal stop surface 46 is stopped by stop tabs 78 thus securing terminal 40 in housing passageway 52, as seen in FIG. 6. Projections 72 are outwardly deflectable by an extraction tool, similarly to converging sections 28 of clip 10 of FIGS. 1 to 3. Preferably, rear body section 74 has a diameter as large as that of passageway 52 at that location: by means of clip 10 engaging the passageway walls thereat and at annulus 54, the terminal is stabilized within the housing. Larger diameter rear body section 74 also acts as a lead-in both for the terminal during terminal insertion and for the extraction tool during its insertion.

Clips 80 of FIG. 5 shows terminal-engaging latching fingers 82 like projections 72 of clip 60 of FIG. 4, and also shows housing-engaging rear lances 84 similar to lances 22 of clip 10 of FIG. 1.

Figure 8:
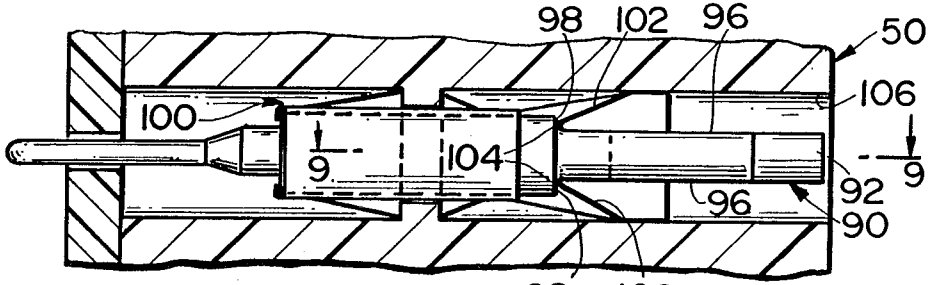
FIG. 8 is a longitudinal view similar to FIGS. 2 and 6 of the terminal of FIG. 7.
Figure 7:
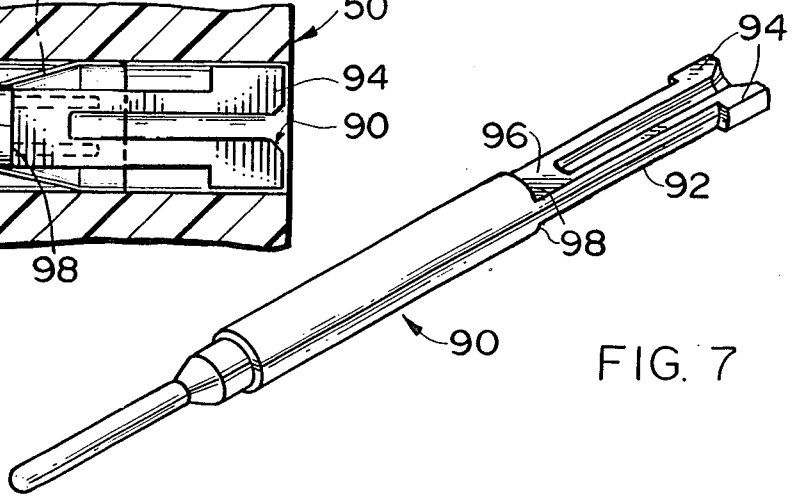
FIG. 7 is a perspective view of a terminal having a socket contact section adapted to be used with a clip of the present invention.

A screw machined terminal having a socket contact section at the rearward end thereof is also adaptable to be used with a retention clip of the present invention. FIG. 7 shows a terminal 90 having a socket contact section 92 modified to be retained by terminal-engaging latching fingers such as either projections 72 of clip 60 in FIG. 4 or sections 28 of clip 10 in FIG. 1. A pair of socket contact beams 94 are modified by machining away portions of opposite outwardly facing sides of socket contact section 92 along the slots between beams 94 to achieve outwardly facing chordal surfaces 96. As shown in FIG. 8, chordal surfaces 96 allow clip projections 102 of clip 100 to resile and free ends 104 thereof to latch behind stop surface portions 98 of terminal 90. Chordal surfaces 96 also permit insertion of a removal tool (not shown) therealong to deflect projections 102 to allow rearward removal of terminal 90 from the housing passageway 106. And if chordal surfaces 96 are created which intersect the pin-receiving cavity entirely therealong, then slots are formed thereby which eliminates separate cutting of the slots between socket contact beams 94.

Figure 9:
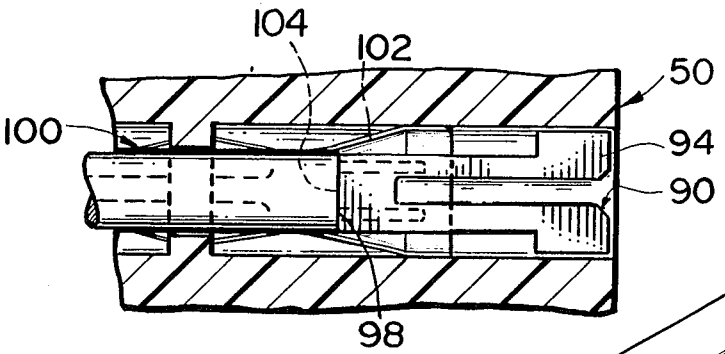
FIG. 9 is part section view taken along lines 9—9 of FIG. 8.
Figure 10:
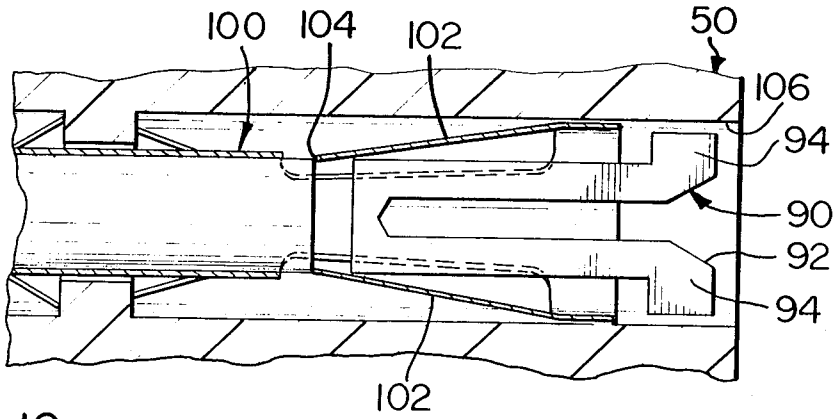
FIG. 10 is an enlarged part section view similar to FIG. 9 with the terminal out of proper orientation.

FIG. 9 shows the socket contact area of FIG. 8 from a 90° rotation. Contact beams 94 receive a mating pin contact section (not shown) therebetween, and a clip projection 102 is shown in phantom engaging behind a respective stop surface portion 98. FIG. 10, in comparison with FIG. 9, shows terminal 90 being about 90° out of angular registry with projections 102 of clip 100 and not latched because projections 102 are along outside surfaces of socket contact beams 94 which effectively prevents projections 102 from resiling inwardly to latch. Terminal 90 is then turned into angular registry with projections 102 to be latched and secured in passageway 106. FIG. 10 also shows a conventional short necked down section 108 of some socket contact terminals, which could permit latching upon proper orientation of the present socket contact section as in FIGS. 8 and 9.

Figure 11:
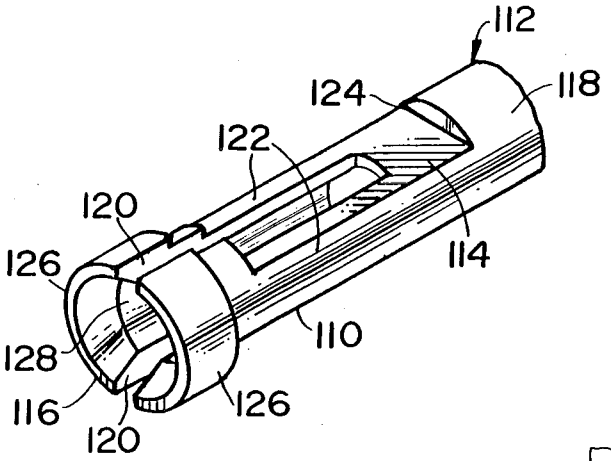
FIG. 11 is a part perspective view of an alternate embodiment of the terminal of FIG. 7.

Chordal surfaces for latching purposes need only be formed at appropriate opposed locations spaced inwardly from the end of the socket contact section. FIG. 11 illustrates a socket contact section 110 of a terminal 112 having chordal surfaces 114 formed inwardly from pin-receiving end 116 near central terminal section 118 and along slots 120 between beams 122, defining rearwardly facing stop surfaces 124. Free ends 126 of beams 122 thus extend almost completely circumferentially about pin-receiving cavity 128 at end 116, so that they comprise an almost continuous lead-in to receive a mating pin contact section thereinto but beams 122 are still deflectable because of slots 120. A removal tool (not shown) is insertable thereinto if it has delatching projections outwardly from a pin shaped central section, which are movable along slots 120.

The present invention allows for same face tool insertion, terminal removal and terminal insertion in a one-piece housing, with the housing passageway having a simple profile with only a simple annular ridge therein easily formed by two-draw molding. The present invention also allows for simple contact terminal structure requiring no annular collars, or annular recesses as in some terminals to receive latches, but simply a larger diameter central body section. The retention clip can be used with terminals terminated to conductor wires having the wires crimped within crimping barrels, so long as the barrels after crimping allow the terminal-engaging latching projections to resile inwardly to latch and allow a terminal removal tool to be inserted therealong.

Variations in the retention clip may be made which are within the spirit of the invention and the scope of the claims.

What is claimed is:

1. A terminal having a socket contact section comprising:

a screw-machined part having a body section of selected diameter and including a forwardly facing stop surface at a forward end of a central section thereof engageable by stop tabs of a retention clip therearound; and a socket contact section extending rearwardly from said central section adapted to receive a mating pin contact section thereinto, said socket contact section having outwardly facing chordal surfaces formed along opposing sides thereof proximate said central section defining receiving areas permitting latching projections of the retention clip therearound to resile radially inwardly thereagainst to latch behind a rearwardly facing stop surface, whereby the terminal is securable in a housing passageway by the retention clip.

2. A terminal as set forth in claim 1 wherein said chordal surfaces extend to a rearward end of said socket contact section.

3. A terminal as set forth in claim 2 wherein said chordal surfaces intersect the pin-receiving cavity of said socket contact section defining separate opposing socket contact beams.

4. A terminal having a socket contact section, comprising a screw-machined cylindrical body having a central section and a socket contact section extending rearwardly therefrom, said socket contact section consisting of a pair of opposing cantilever beams defined by outwardly facing chordal surfaces machined on opposing outwardly facing sides of a rearward end of the cylindrical body intersecting a central bore formed into said rearward end of said cylindrical body, to receive therebetween a pin contact section of a mating contact.

5. A terminal as set forth in claim 4 wherein said cantilever beams include lead-in surfaces at the ends thereof to facilitate receipt of a pin contact section therebetween.

6. A method of forming an electrical terminal having a socket contact section, comprising the steps of:

selecting a cylindrical metal body;

forming a bore into an end face thereof, to a selected depth; and machining a selected length of said cylindrical body proximate said end face a selected distance on opposing outwardly facing sides to form outwardly facing chordal surfaces intersecting said bore and defining opposing cantilever beams comprising a socket contact section.

7. A method as set forth in claim 6 further including the step of forming tapered surfaces at the outward end of said bore, defining lead-in means to facilitate receipt of a pin contact section of a mating contact terminal into the socket contact section.

* * * * *